United States Patent [19]

Stringer

[11] Patent Number: 4,630,762

[45] Date of Patent: Dec. 23, 1986

[54] MANNEQUIN

[75] Inventor: Richard G. Stringer, London, England

[73] Assignees: R. G. Stringer; Andre Clive Michell, both of London, England

[21] Appl. No.: 766,128

[22] Filed: Aug. 15, 1985

[51] Int. Cl.[4] ..... A41H 5/00

[52] U.S. Cl. ..... 223/66; 223/68

[58] Field of Search ..... 223/66, 68

[56] References Cited

U.S. PATENT DOCUMENTS 1,579,367 4/1926 Hymer ..... 223/68 X
2,362,383 11/1944 Lendinara ..... 223/68 X
2,632,586 4/1953 Barrango ..... 223/68
3,319,846 5/1967 Wolf ..... 223/68
3,357,610 12/1967 Quinby ..... 223/68

FOREIGN PATENT DOCUMENTS 1123504 9/1956 France ..... 223/68

*Primary Examiner*—Louis K. Rimrodt
*Attorney, Agent, or Firm*—Harness, Dickey & Pierce

[57] ABSTRACT

A mannequin comprising a frame representing a human torso, a plurality of elongate rods, representing the upper arm and forearm and the thighs and calves of a human body and a plurality of lockable swivel joints connecting the thigh rods and the upper arm rods to the frame, connecting the forearm rods to the upper arm rods and connecting the calf rods to the thigh rods.

6 Claims, 2 Drawing Figures

MANNEQUIN

BACKGROUND OF THE INVENTION

The present invention relates to mannequins.

Mannequins suitable for use, for example, in store windows, conventionally have had the form of a human body accurately representing the torso, head and limbs of the body. However, such mannequins are rather expensive and tend to have a fixed format which cannot be varied to suit a particular requirement.

In more recent times, it has been proposed to provide mannequins essentially consisting of heavy duty wire, which can be bent to represent the torso and limbs of a human body, but these of limited strength and application.

SUMMARY OF THE INVENTION

It is an object of the present invention to provide an improved mannequin which is readily variable to suit the requirements of a particular user.

It is a further object of the present invention to provide a robust and adjustable mannequin which is inexpensive to manufacture and which can readily be adjusted and varied in its configuration.

The invention provides a mannequin comprising a frame representing a human torso a plurality of elongate rods, representing the upper arm and forearm and the thighs and calves of a human body and a plurality of lockable swivel joints connecting the thigh rods and the upper arm rods to the frame, connecting the forearm rods to the upper arm rods and connecting the calf rods to the thigh rods.

Other and further objects, features and advantages of the present invention will be readily apparent to those skilled in the art upon a reading of the description of a preferred embodiment which follows, when taken in conjunction with the accompanying drawings.

DESCRIPTION OF PREFERRED EMBODIMENT

Figure 1:
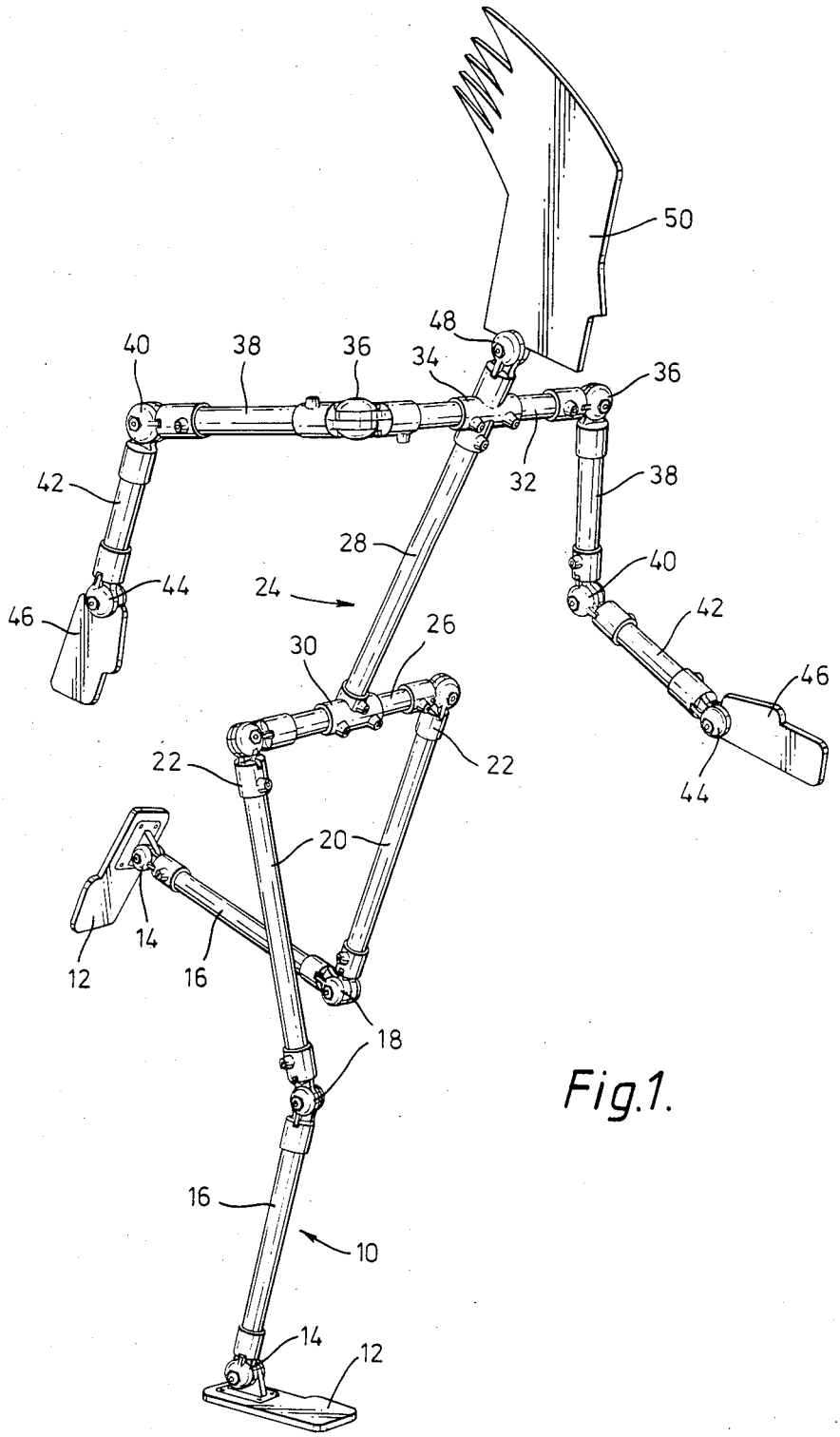
FIG. 1 is a perspective view of a mannequin according to the present invention.

The mannequin 10 illustrated in FIG. 1 includes a pair of plate-like foot-forming members 12 having a generally flat ground engaging surface lower surfaces. Bolted to the each member 12 is a first swivel joint 14 to each of which is connected a first pair of tubular metal rod members 16 forming calves of the mannequin. A second pair of swivel joints 18 forming the knees of the mannequin are connected to a second pair of tubular rods 20 forming the thighs of the mannequin, these having, at their upper ends, a third pair of swivel joints 22.

A frame indicated by the general reference numeral 24 forms the torso of the mannequin and includes a first transverse rod 26, representing the pelvis of the mannequin, an upright rod 28 connected by an adjustable connection 30 to the first transverse rod 26, and a second transverse rod 32 connected by an adjustable connection 34 to the rod 28.

The second pair of elongate rods 20 is connected to the first transverse member, that is to say, rod 26 by the third pair of swivel joints 22.

A fourth pair of swivel joints 36 forms the shoulder joints of the mannequin and to these are connected a third pair of elongate rod-like tubes 38 forming the upper arms of the mannequin, and to the lower ends of these are connected to a fifth pair of swivel joints 40 forming the elbows of the mannequin to which are connected forearm forming rods 42. At the ends of these rods 42 are a fifth pair of swivel joints 44 to which are connected hand forming portions 46.

Connected to the frame 24, generally centrally thereof, and by a seventh swivel joint 48, is a head forming member 50.

Figure 2:
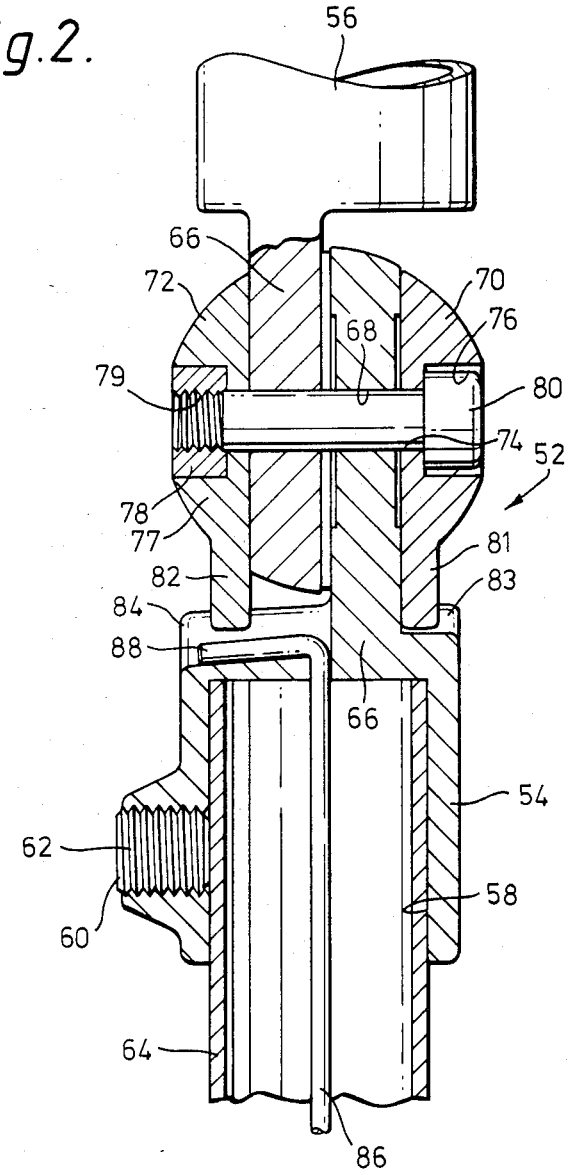
FIG. 2 is an enlarged side elevation, partly in cross-section, of one embodiment of swivel joint suitable for use with the mannequin of FIG. 1.

FIG. 2 shows a particular form of swivel joint indicated by the general reference numeral 52. This includes a first element 54 and a second element 56, each in the form of a tube having a blind recess 58 shaped to accommodate the end of one of the rods. A transverse threaded hole 60 accommodates a screw 62 which can be tightened against an end portion of a tubular rod which is indicated by the reference numeral 64 in FIG. 2. Each element 54 includes a wing 66 having a throughbore 68 therein. Two side members 70 and 72 are provided, these having a bore 74 in the member 70 which is countersunk at 76 and a hexagon widening 77 carrying a hexagon nut 78 which is threaded at 79 to receive a threaded bolt 80 which may be provided with a hexagon socket for tightening. Wings 81, 82 on the members 70, 72 engage in slots 83, 84 in the member 54.

A metal wire 86 which is bent at the end 88 also engages the slot 84 and can extend the full length of the tubular rod 64 and can have, at its other end, a similar bent portion 88.

It will be apparent that when one wishes the mannequin to take up a particular position one slacks off the bolt 80 and then rotates the two elements 54, 56 relative to each other to the desired position then tightens up the bolt. The tubular rods 64 themselves can be adjusted both longitudinally and rotationally and the wire 86 with its bent end 88 will tend to return the sockets to a median position, so that when the grub screw 62 are released, the swivel joints will tend to reorientate themselves.

I claim:

1. A mannequin comprising, in combination:

(a) a pair of feet forming members;

(b) a first pair of elongated rads forming calves of said mannequin, each having upper and lower ends;

(c) first lockable swivel joints connecting the lower ends of each of said rods of the first pair, each to a separate one of said feet forming members;

(d) a second pair of elongated rods forming thighs of said mannequin, each having upper and lower ends;

(e) second lockable swivel joints connecting the lower ends of each of said rods of the second pair to the upper end of a separate one of the rods of the first pair;

(f) a frame including a first transverse rod forming a pelvis of said mannequin and a second transverse rod forming shoulders of said mannequin, said first and second rods each having ends;

(g) third lockable swivel joints each connecting one of the ends of said first transverse rods to a separate one of the upper ends of said second elongate rods;

(h) a third pair of rods, forming upper arms of said mannequin and having upper and lower ends;

(i) fourth lockable swivel joints each connecting one of the ends of said second transverse rod to a separate one of the upper ends of said third pair of rods;

(j) a fourth pair of rods, forming forearms of said mannequin and having upper and lower ends;

(k) a fifth pair of lockable swivel joints connecting the upper ends of said fourth pair of rods to the lower ends of said third pair of rods;

(l) a pair of hand forming members each mounted at the lower end of a separate one of said fourth pair of rods;

(m) a head forming member secured to the frame;

(n) means on each of said swivel joints permitting said swivel joints to be locked in any one of a number of different positions, and (o) said lockable swivel joints each comprising first and second pivotal elements, a threaded pivot pin passing through said first and second elements and allowing said elements to pivot relative to one another about a first axis, a third element formed separately from the first and second elements and positioned on the side of the second element remote from said first element, complementary thread means on said third element effective to receive said threaded pin, means to prevent significant rotation of said third element relative to said first element, whereby tightening of said pin locks said first and second elements against rotation about said first axis, means allowing an elongated rod to be attached to each end of said first and second elements, while allowing relative rotation between the elongate rod and the associated one of said first and second elements about the axis of the elongate rod and means to secure the end of each elongated rod to the associated first or second element.

2. A mannequin as claimed in claim 1 and further comprising a sixth pair of swivel joints connecting each of said hand forming members to separate one of the lower ends of said fourth pair of rods.

3. A mannequin as claimed in claim 1, and further comprising a seventh swivel joint pivotally connecting said frame to said head forming member.

4. A mannequin as claimed in claim 1, wherein said frame comprises a central, generally vertically extending rod, having upper and lower ends, and means connecting said upper and lower ends to a central portion of said first and second transverse members.

5. A mannequin as claimed in claim 4, wherein said connecting means are adapted to allow longitudinal adjustment of said central vertically extending rod.

6. A mannequin comprising a frame representing a human torso, a plurality of elongated rods, representing the upper arm and forearm and the thighs and calves of a human body and a plurality of lockable swivel joints connecting the thigh rods and the upper arm rods to the frame, connecting the forearm rods to the upper arm rods and connecting the calf rods to the thigh rods, said lockable swivel joints each comprising first and second pivotal elements, a threaded pivot pin passing through said first and second elements, a third element formed separately from said first and second elements and positioned on the side of said second element remote from said first element, complementary thread means on said third element effecitve to receive said threaded pin, whereby tightening of said threaded pin locks said swivel joint, and means an elongate rod to be attached to each end of said first and second elements, while allowing relative rotation between the elongate rod and the associated one of said first and second elements about the axis of the elongate rod and means to secure the end of the each elongate rod to the associated first or second element.

* * * * *